US009084460B2

(12) United States Patent
Richards

(10) Patent No.: US 9,084,460 B2
(45) Date of Patent: Jul. 21, 2015

(54) PORTABLE DEVICE FOR STORING AND RETRIEVING ITEMS OF APPAREL

(76) Inventor: Stephen B. Richards, Houston, TX (US)

( * ) Notice: Subject to any disclaimer, the term of this patent is extended or adjusted under 35 U.S.C. 154(b) by 32 days.

(21) Appl. No.: 13/601,780

(22) Filed: Aug. 31, 2012

(65) Prior Publication Data

US 2014/0027225 A1 Jan. 30, 2014

(51) Int. Cl.

| | |
|---|---|
| ***A47B 57/06*** | (2006.01) |
| ***A45C 9/00*** | (2006.01) |
| ***A45C 7/00*** | (2006.01) |

(52) U.S. Cl.

CPC ..... *A45C 9/00* (2013.01); *A45C 7/0031* (2013.01)

(58) Field of Classification Search

CPC ..... A47B 61/06; A45C 13/03; A45C 5/00; A45C 5/04; A45C 5/065

USPC ..... 190/1, 11, 12 R, 12 A, 13 R, 104, 107, 190/109, 110, 111, 15 R, 16; 206/282, 286, 206/290, 298; 312/306; 383/22; 5/99.1

See application file for complete search history.

(56) References Cited

U.S. PATENT DOCUMENTS

| | | | | |
|---|---|---|---|---|
| 1,411,694 A | | 4/1922 | Grube | |
| 1,418,564 A | | 6/1922 | Hamlin | |
| 2,476,932 A | * | 7/1949 | Tucker | 206/290 |
| 4,267,905 A | * | 5/1981 | Stewart | 190/13 R |
| 4,982,820 A | * | 1/1991 | Scott | 190/16 |
| 6,398,323 B1 | | 6/2002 | Lee | |
| 2005/0073223 A1 | | 4/2005 | Shai | |
| 2010/0117499 A1 | * | 5/2010 | Fortier | 312/306 |

FOREIGN PATENT DOCUMENTS

| | | |
|---|---|---|
| GB | 311354 | 4/1929 |
| GB | 377302 A | 7/1932 |

OTHER PUBLICATIONS

Written Opinion of the International Search Authority, WO/2013/016572, dated Jan. 26, 2015, 3 pages.

Chinese Patent Office, First Office Action, Application No. 201280035386.9, dated Feb. 3, 2015, 7 pages.

* cited by examiner

*Primary Examiner* — Fenn Mathew
*Assistant Examiner* — Cynthia Collado
(74) *Attorney, Agent, or Firm* — Merek, Blackmon & Voorhees, LLC

(57) ABSTRACT

The portable device for storing and retrieving items of apparel reduces the burden of packing and unpacking items. The portable device comprises a housing made of a first housing member and a second housing member (20, 30, 90) that is attached to at least one extension member (10, 28). The extension member can hold a plurality of apparel items (12). The portable device can be opened to view all of the well-organized items or the luggage can be closed to move the items as desired by a user. This can enable the user to easily travel without the burden of packing and unpacking because the items only leave the luggage when the items are in use.

6 Claims, 5 Drawing Sheets

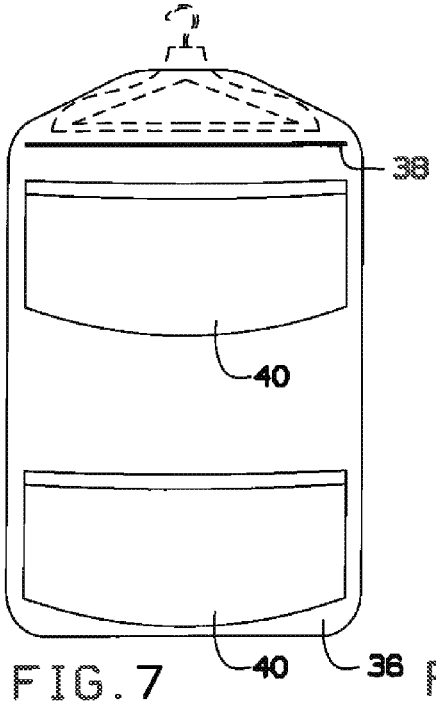
FIG. 7
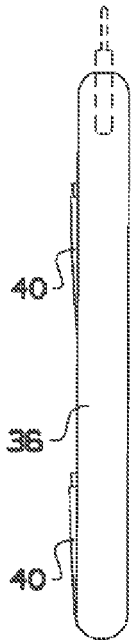
FIG. 8
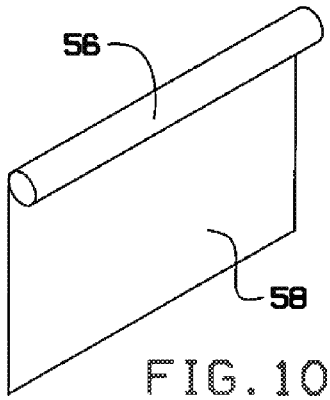
FIG. 10
FIG. 11
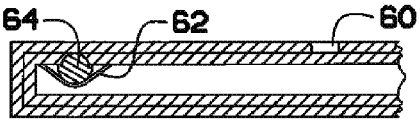
FIG. 12
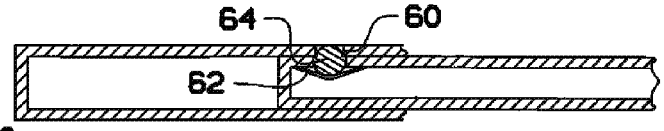
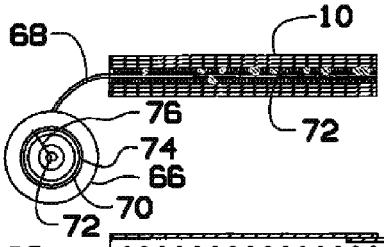
FIG. 13
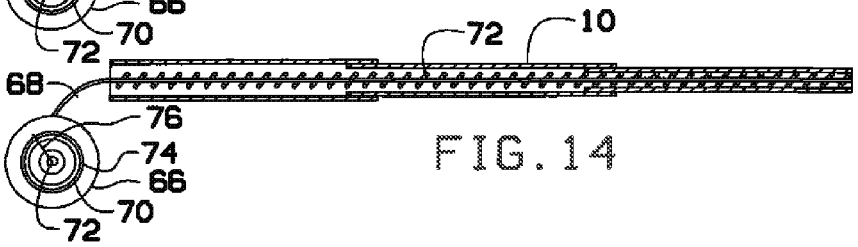
FIG. 14

PORTABLE DEVICE FOR STORING AND RETRIEVING ITEMS OF APPAREL

STATEMENT OF RELATED APPLICATIONS

This application claims priority to International Application PCT/US12/48396 filed on Jul. 26, 2012.

FIELD OF THE INVENTION

This invention relates to containers comprised of a plurality of housing members, and having an access opening.

BACKGROUND OF THE INVENTION

Prior to the disclosed invention, a user had to pack and unpack for a trip by placing items in a container and removing those items from a container. The arrangement of structural members in the container made inserting and removing items into the container needlessly time consuming and cumbersome as shown below. The present invention eliminates the need to pack and unpack and the time consumed by doing such.

Turning briefly to the prior art, U.S. Pat. App. No. 2010/0117499 A1 by Fortier teaches a telescopic storage device. The device comprises a series of shelves stacked one upon another with telescoping poles. The purpose of the extension members is to make the device portable while not in use. This has little to do with the present invention which teaches transporting apparel items on a extension member whether the member is expanded or contracted. Fortier teaches transporting material only in an expanded position.

U.S. Pat. No. 2,476,932 issued to Trucker teaches a traveling case having a divided fabric sections. The device comprises a coat rack covered by a divided fabric sections. However, it does not teach extension members, rather, the entire device has a fixed construction and it simply solves a problem that existed in WWII that has matured into the problem the disclosed invention now seeks to solve.

U.S. Pat. No. 7,607,535 issued to Jackson teaches a apparel items container with an extendable apparel items hanging system. Basically, a user can pull a apparel items hanger upwards from a piece of luggage. The present invention teaches extension members that can carry apparel items whether the extension member is expanded or contracted. Were Jackson to contract his device, apparel items would fall to the floor.

BRIEF SUMMARY OF THE INVENTION

The present invention teaches a portable device for storing and retrieving items of apparel. The portable device comprises, a housing comprising at least a first housing member and a second housing member configured to detachably engage each other to selectively close and open the housing as desired, and at least one telescoping extension member affixed to one of the two housing members. The extension member is configured so as to be minimized when the at least two housing members are engaged to each other, and to be maximized when the at least two housing members are detached. The extension member is further configured to support a plurality of apparel items thereon in a manner so that whether minimized or maximized the apparel items remain suitably supported so that the items need not be removed when the housing members are engaged for transport.

BRIEF DESCRIPTION OF THE SEVERAL VIEWS OF THE DRAWINGS

Figure 1:
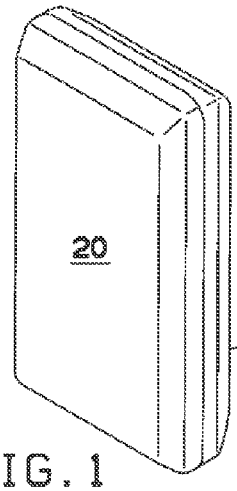

Having thus described the invention in general terms, reference will now be made to the accompanying drawings, which are not necessarily drawn to scale, and wherein:

FIG. 1 is a perspective view of an embodiment of the invention illustrated in contracted state.

Figure 2:
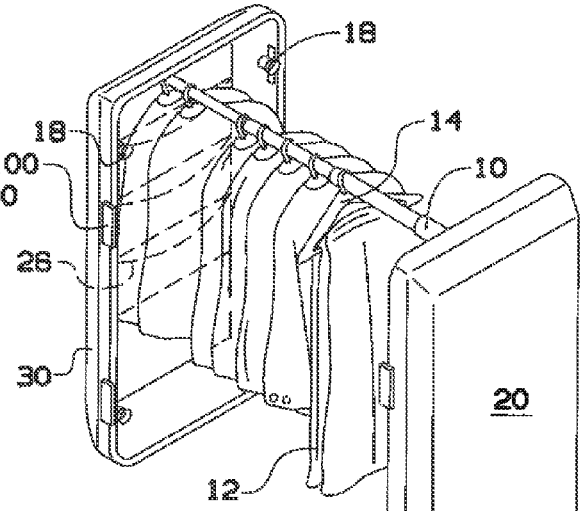

FIG. 2 is a perspective view of an embodiment of the invention illustrated in expanded state.

Figure 3:
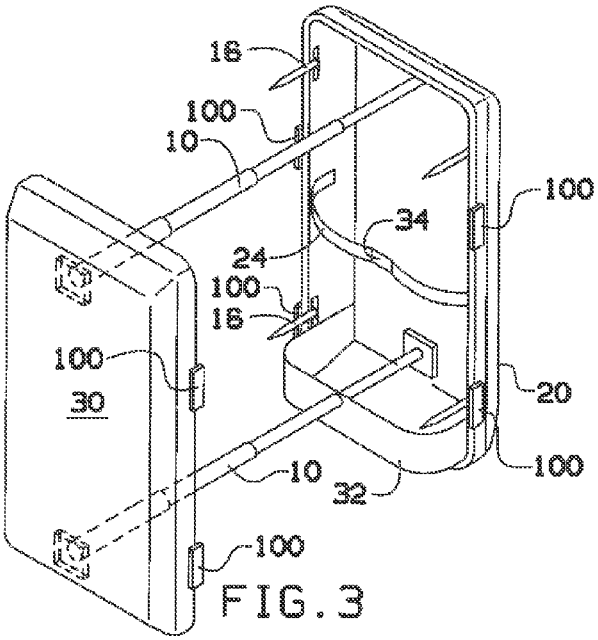

FIG. 3 is a perspective view of an embodiment of the invention illustrated in expanded state.

Figure 4:
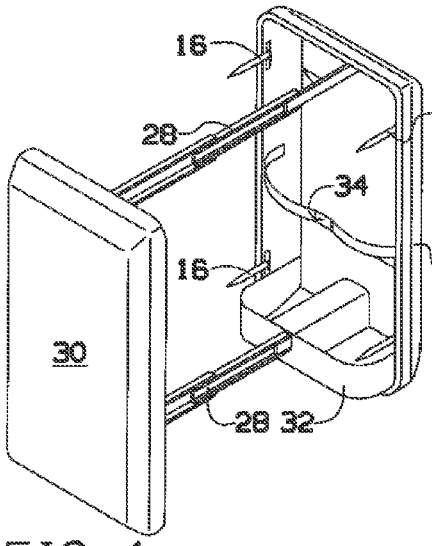

FIG. 4 is a perspective view of an alternate embodiment of the invention illustrated in expanded state.

Figure 5:
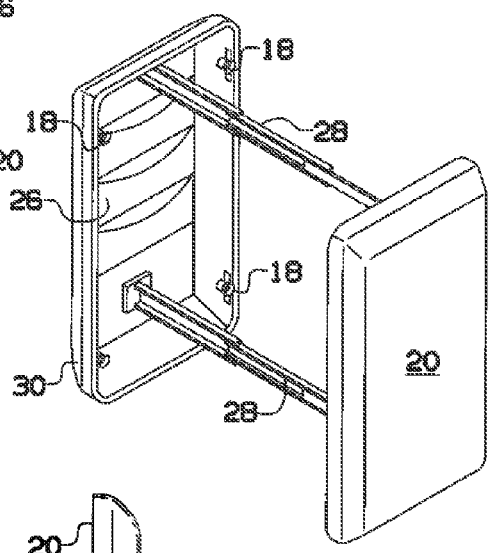

FIG. 5 is a perspective view of an alternate embodiment of the invention illustrated in expanded state.

Figure 6:
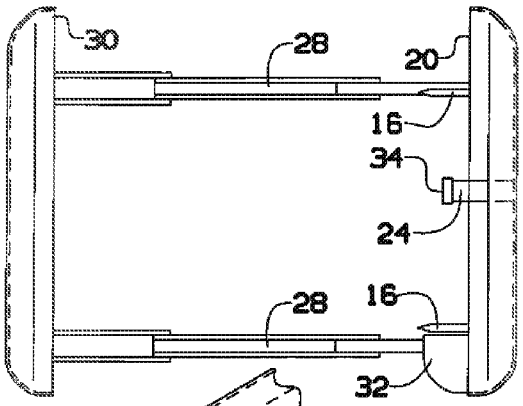

FIG. 6 is a perspective view of an alternate embodiment of the invention illustrated in expanded state.

FIG. 7 is a front view of the laundry bag only.

FIG. 8 is a side view of the laundry bag only.

Figures 9, 15, 17:
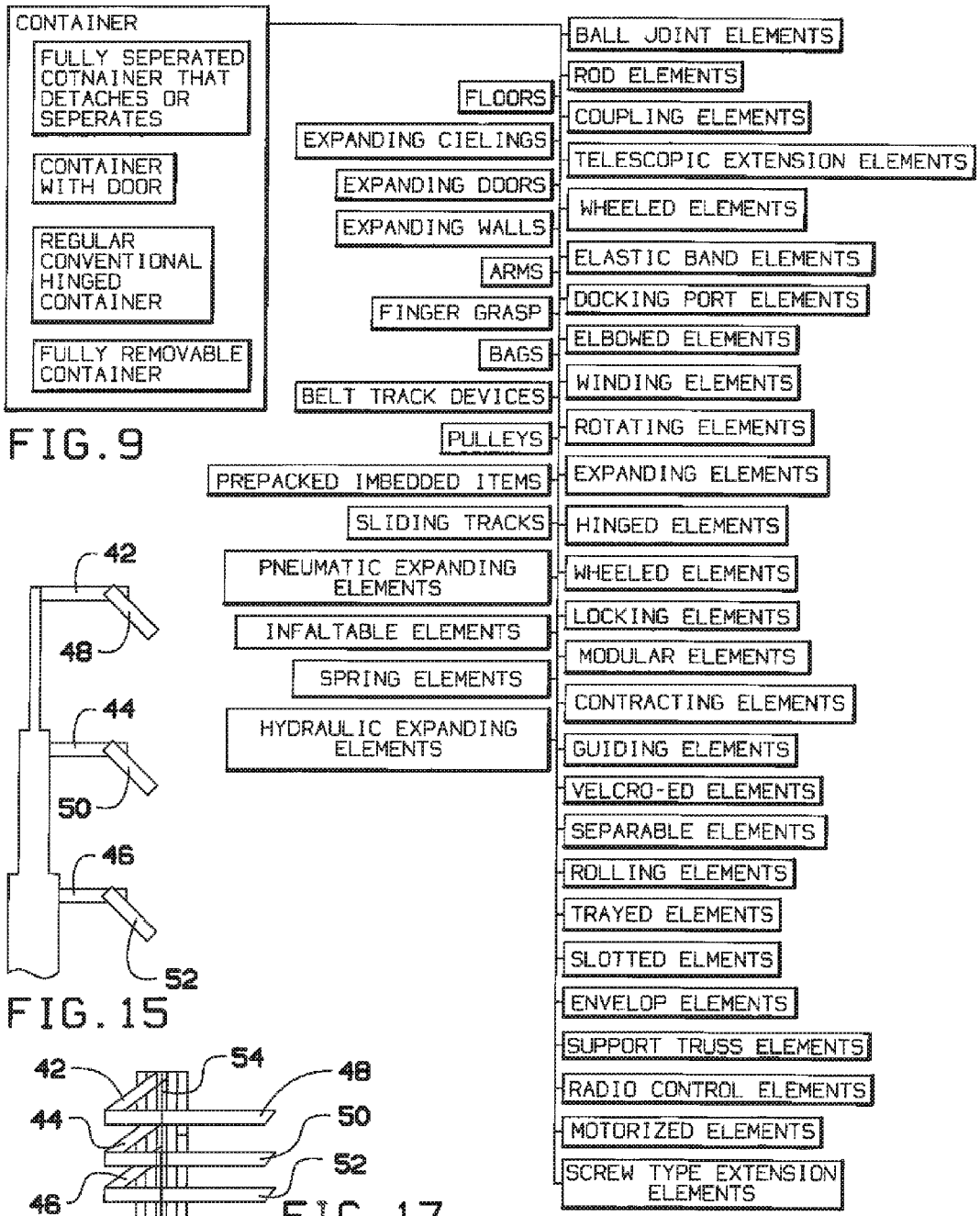

FIG. 9 is a schematic view of the invention.

FIG. 10 is a perspective view of the invention belt track device window shade.

FIG. 11 is a section view of the invention locking extension member illustrated in closed position.

FIG. 12 is a section view of the invention locking extension member illustrated in extended position.

FIG. 13 is a section view of the extension member with interior springs and interior wire connected to retractable spool showed in closed position.

FIG. 14 is a section view of the extension member with interior springs and interior wire connected to retractable spool showed in extended position.

FIG. 15 is a front view of the extension member with vertical slots and tracks for axles illustrated in extended configuration.

Figure 16:
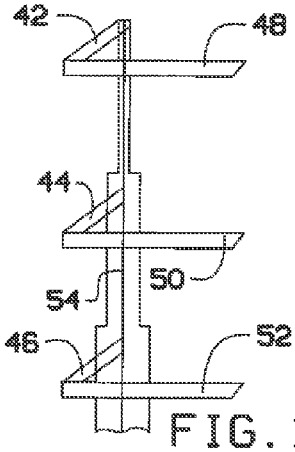

FIG. 16 is a side view of the extension member with vertical slots and tracks for axles illustrated in extended configuration.

FIG. 17 is a side view of the extension member with vertical slots and tracks for axles illustrated in contracted configuration.

Figure 18:
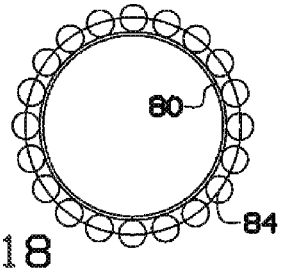

FIG. 18 is a top view of the invention for the ball bearing rings for the interior ball bearing assisted telescopic poles.

Figure 19:
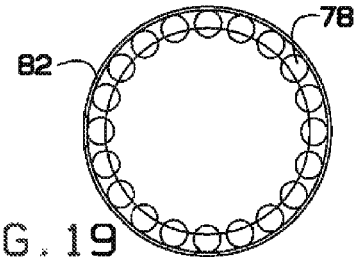

FIG. 19 is a top view of the invention for the ball bearing rings for the exterior ball bearing assisted telescopic poles.

Figure 20:
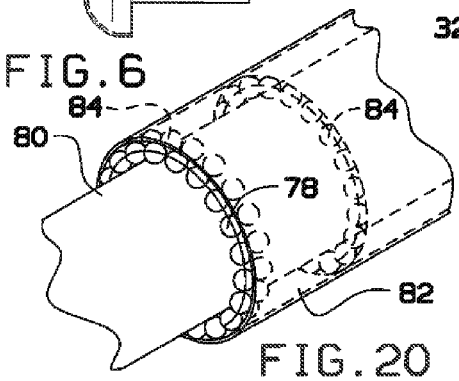

FIG. 20 is a perspective view of the invention for the ball bearing assisted telescopic poles.

Figure 21:
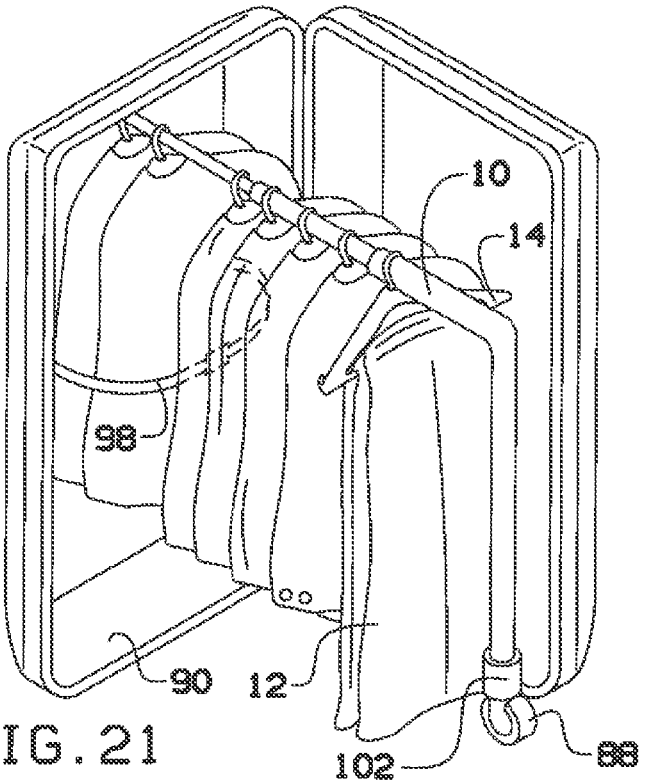

FIG. 21 is a perspective view of an alternate embodiment of the invention.

Figure 22:
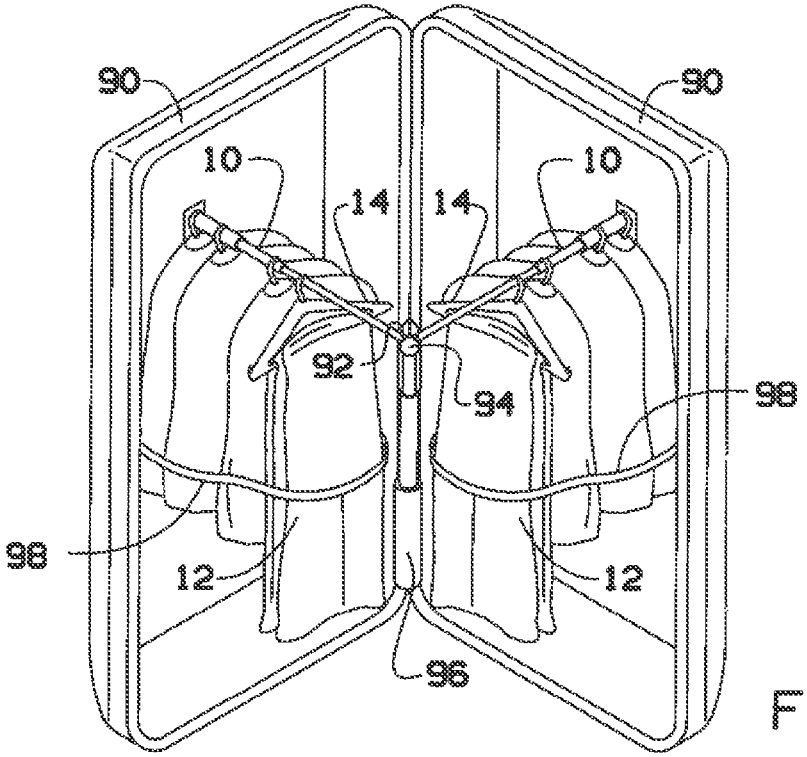

FIG. 22 is a perspective view of an alternate embodiment of the invention.

DETAILED DESCRIPTION OF THE INVENTION

Embodiments of the present invention overcome many of the obstacles associated with packing and unpacking while traveling, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

There are numerous portable containers that can be configured with extension members in numerous manners. The following configurations are merely exemplary. By way of example FIG. 9 provides a possible flow chart of the numerous possibilities for apparatus assembly. A user can create a container to be one of: a full separated container that detaches or separates (FIG. 1, FIG. 2, FIG. 3, FIG. 4, FIG. 5, FIG. 6); a hinged container (FIG. 21, FIG. 22), a container with a door or a fully removable container door. Those containers can be assembled to have floors, telescopic poles, expanding ceilings, expanding doors, expanding walls, arms, finger grasps, bags, belt track device, pulleys, pre-packed imbedded elements, sliding tracks and more as explained in FIG. 9. Additionally, portable containers can be assembled with elements. A common theme through these containers is at least one extension member, which is described in more detail in the embodiments below.

FIG. 1 and FIG. 2 show a portable container comprising a housing. The housing comprises first housing member 20 and second housing member 30 detachably engaged by telescoping pole 10. Here telescoping pole 10 is affixed to first housing member 20 and second housing member 30. In this embodiment, telescoping pole 10 is an extension member. In this configuration, telescoping pole 10 can be minimized when the two housing members are engaged to each other (as shown in FIG. 1) or maximized when the two housing members are detached (as shown in FIG. 2). Telescoping pole 10 is sturdy and made of sufficiently strong material to hold a plurality of hangers 14 which further contain a plurality of apparel items 12.

Second housing member 30 is mechanically coupled to female coupling 18 which can accommodate male guidepost 16 (as shown in FIG. 3). Second housing member 30 is further mechanically coupled to pockets 26 which can store additional items. Locks 100 can engage to secure the portable container. Additionally, locks 100 can be incorporated with male guidepost 16 and female coupling 18 depending on user preference.

FIG. 3 shows the portable container comprising a housing. Here, second telescoping pole 10 is also attached to first housing member 20 and second housing member 30. First housing member 20 is mechanically coupled to basket 32 that eliminates the possibility apparel items 12 becoming caught between first housing member 20 and second housing member 30 while contracting the two housing members. Ribbon 24 is further mechanically coupled to buckle 34 which can be used to secure apparel items 12 in transit.

FIG. 4, FIG. 5 and FIG. 6 show an alternate embodiment of the extension member. Here, a first telescopic track 28 is attached to first housing member 20 and second housing member 30. As indicated above, second housing member 30 is mechanically coupled to female coupling 18 which can accommodate male guidepost 16. Second housing member 30 is further mechanically coupled to pockets 26 which can store additional items. Locks 100 can engage to secure the portable container. First housing member 20 is mechanically coupled to basket 32 which prevents articles from obstructing the housing members from engaging. Ribbon 24 is further mechanically coupled to buckle 34 which can be used to secure apparel items 12 in transit.

This configuration is exemplary and other forms of telescopic extension members can be utilized in addition to telescopic track 28 such as columnar telescopic extension members or screw type extension members.

FIG. 21 shows an alternate embodiment of the extension member. Here, the extension member is telescoping pole 10 adjacent to a second pole where the second pole comprises spring housing sleeve 102. Spring housing sleeve 102 is mechanically coupled to wheel with springs 88. Apparel items 12 hung from telescoping pole 10 by hanger 14 can be secured to hinged container 90 by ribbon 98 which further comprises a couple (not shown) in a similar construction to ribbon 24 described above. Hinged container 90 comprises a first housing member mechanically coupled to a second housing member by a hinge.

FIG. 22 shows an alternate embodiment of the extension member. Here, the extension member is a first telescoping pole 10. First telescoping pole 10 is mechanically coupled to attach ball joint 94. Ball joint 94 is further attached to a second telescoping pole 10 and a vertical extension member. Here, the vertical member is locking telescoping pole 96. Ball joint 94, is an example of a connection that fulfills this purpose, however, any device with the ability to swivel is sufficient. In this configuration second telescoping pole 10 is a second extension member and locking telescoping pole 96 is a third extension member. Locking telescopic pole 96 can be lowered and used to support both telescopic poles 10, which support apparel items 12 hung from hanger 14 on first telescoping pole 10 and second telescoping pole 10. Alternately, or in conjunction with locking telescoping pole 96, a user can hold onto loop 92 to provide support or to extend ball joint 94 away from hinged container 90. In this manner, first telescoping pole 10 and second telescoping pole 10 can extend away from the housing while providing support for apparel items 12 suspended from first telescoping pole 10 and second telescoping pole 10. Hinged container 90 comprises a first housing member mechanically coupled to a second housing member by a hinge.

The devices described in FIG. 1, FIG. 2, FIG. 3, FIG. 4, FIG. 5, FIG. 6, FIG. 21, and FIG. 22 can use laundry bag 36 to store dirty laundry as shown in FIG. 7 and FIG. 8. Laundry bag 36 can be used to segregate clean apparel items 12 from apparel items 12 that require laundering. Laundry bag 36 can be accessed by laundry bag zipper 38 and is mechanically coupled to laundry bag pocket 40. Laundry bag 36 can be hung from an extension member by hanger 14. Laundry bag 36 can be temporarily coupled to housing member 30 by a hook and loop fastener such as the one trademarked under the name Velcro®, snaps, zipper, buttons or in any other known manner to keep apparel 12 hanging upon hanger 14 which can rest upon telescopic pole 10 or telescopic track 28 adjacent to the housing member coupled to ribbon 34 or ribbon 98. The detachable coupling between the vertical edges of laundry bag 36 the interior container walls can be made of known materials.

The extension member can be built in a large number of ways including utilizing docking port element (FIG. 11, FIG. 12), utilizing rotating elements such as a retractable spool (FIG. 13, FIG. 14), utilizing a telescoping pole (FIG. 18, FIG. 19, FIG. 20) and utilizing a telescopic track (FIG. 15, FIG. 16, FIG. 17).

Of course, these configurations are exemplary and additional extension members can be used such as screw type extension members, pneumatic extension members, and hydraulic extension members.

FIG. 11 and FIG. 12 show docking port 60. In this example, telescopic pole 10 can have its movement stopped and locked into the extended position by having media ball 64 inserted into docking port 60. In some embodiments, media ball 64 is pulled into docking port 65 elastic band 62.

Turning to FIGS. 13 and 14, a variety of extension member is explained. Retractable spool 66 comprises spring 72 mechanically coupled to wind cord 74 which includes wire 68. Retractable spool 66 comprises slot 70. Arm 76 protrudes from slot 70. In some embodiments arm 76 is L-shaped and wire 68 can be a cord made of material rather than a wire made of metal. When the extension member is extended retractable spool 66 is would and when retractable spool 66 is released, the extension member is contracted as spring 72 pulls wire 74 that is attached to most interior components of extension member 10.

Turning to FIG. 15, FIG. 16 and FIG. 17, first pole 48 slides upon first U-shaped track 42, second pole 50 slides upon second U-shaped track 44 and third pole 52 slides upon third U-shaped track 46. In use, a series of drawers (not pictured) can rest upon first pole 48, second pole 50 and third pole 52.

FIG. 18 shows ball bearing ring 80 with housing ball bearings 84 protruding through the housing. Ball bearing ring 80 is mechanically coupled to the outside of interior telescopic poles.

FIG. 19 shows ring 82 with housing ball bearings 78 protruding through the housing. Ball bearing ring 82 is mechanically coupled to the inside external telescopic poles at the end of the external telescopic pole.

FIG. 20 shows a ball bearing assisted telescopic pole. FIG. 20 shows and interior pole with ball bearing ring 84 mechanically coupled to the outside of the interior pole. In some configurations, ball bearing ring 84 can be welded to the outside of the interior pole. FIG. 20 also shows an exterior pole with ball bearing ring 78 mechanically coupled to its interior located terminus of the exterior pole. Alternately, the ball bearings may be stationary and attached to ball bearing ring 84 and still reduce friction since the surface and contact between the interior elements of the extension member is reduced to a ball bearing point of contact with the adjacent element of the extension member.

FIG. 20 shows the collision of ball bearing ring 78 with ball bearing ring 84. This collision stops movement of the interior pole as it moves inside the exterior pole and not only does it stop movement, but it prevents the interior pole and the exterior pole from separating. The position of the second ball bearing ring 84 relative to the first ball bearing ring 84 that collides with ball bearing ring 78 acts as a fulcrum and eliminates the interior telescopic pole and the exterior telescopic pole from sagging. Ball bearing assisted telescopic poles as shown in FIG. 18, FIG. 19, and FIG. 20 limit friction to just the surface of the ball bearings so the interior pole glides smoothly against the exterior pole and the exterior pole glides smoothly against the interior pole.

As noted in FIG. 9 there is an assortment of additional components that can be added to a portable container including rolled vinyl 56 which is explained in FIG. 10. FIG. 10 shows rolled vinyl 56. Rolled vinyl 56 can be unrolled to reveal hanging vinyl 58. A user can utilize rolled vinyl 56 to cover apparel items 12 on hanger 14.

That which is claimed:

1. A portable device for storing and retrieving items of apparel, the portable device comprising:

a housing comprising first and second cooperating housing members selectively, detachably engaged to each other for completely enclosing the items of apparel in a first, stored state and for providing access to the items of apparel in a second, deployed state;

at least one telescoping extension member affixed to at least one of the two housing members, wherein said telescoping extension member is mounted within said first and second cooperating housing members and is completely enclosed within said housing when said housing is in said first, stored state;

said telescoping extension member being arranged at a top end of said housing to suspend said apparel completely within said housing by at least one hanger thereon when said housing is in said first, stored state;

the telescoping extension member configured so as to be minimized between the two housing members when the two housing members are engaged to each other, and to be maximized when the two housing members are detached;

the telescoping extension member further configured to support the apparel items hanging thereon so when maximized, the plurality of apparel items remain hung on said telescoping extension member when said housing is said second, deployed state and are accessible from outside of said housing.

2. The portable device of claim 1, wherein the extension member is secured to the second housing member at an attachment point, where said attachment point is located centrally along a top portion of one of said housing members.

3. The portable device of claim 1, wherein a second extension member is affixed to a bottom portion of one of the two housing members and the second extension member is secured to the extension member.

4. The portable device of claim 1, wherein a second extension member is affixed to one of the two housing members and the second extension member is secured to the second housing member.

5. The portable device of claim 1, wherein the extension member is attached only to one of the first and second housing members and includes a vertical member attached to a wheel for supporting the telescoping member.

6. The portable device of claim 1, further comprising a second extension member affixed to one of the two housing members and the second extension member is secured to the extension member at a connection; the connection is mechanically coupled to a third extension member.

* * * * *